US005806707A

United States Patent [19]

Boehm et al.

[11] Patent Number: 5,806,707

[45] Date of Patent: Sep. 15, 1998

[54] REMOVABLE INNER PROMOTIONAL COMPARTMENT CLOSURE AND PROMOTIONAL GAMING SYSTEM

[75] Inventors: Ted W. Boehm; David L. Cerny, both of Crawfordsville; Wendell D. Willingham, Zionsville; Daniel J. Denman, Crawsfordsville; Sheldon L. Wilde, Indianapolis; Stephen W. McBride, Brownsburg; Hugh C. Urmston, Carmel, all of Ind.; Ralph H. Whitney, North Pole, Fla.

[73] Assignee: Alcoa Closure Systems International, Inc., Crawfordsville, Ind.

[21] Appl. No.: 746,773

[22] Filed: Nov. 15, 1996

[51] Int. Cl.[6] ..... B65D 85/00

[52] U.S. Cl. ..... 220/522; 40/311; 206/217; 215/341; 215/345; 215/232; 215/305; 215/227; 220/780; 220/521; 220/256; 273/138.1

[58] Field of Search ..... 220/255, 780, 220/256, 258, 212, 521, 522; 215/341, 228, 342, 232, 343, 345, 295, 296, 305, DIG. 7, DIG. 8, 227; 206/457, 217; 40/310, 311; 273/138.1, 139, 138 A, 138 R

[56] References Cited

U.S. PATENT DOCUMENTS

| | | | |
|---|---|---|---|
| 1,624,407 | 4/1927 | Hamilton | 220/522 X |
| 2,615,448 | 10/1952 | Fields | 215/DIG. 8 X |
| 2,936,089 | 5/1960 | Goldfarb et al. | 220/522 X |
| 3,434,620 | 3/1969 | Laurizio | 220/258 |
| 4,024,952 | 5/1977 | Leitz | 251/DIG. 8 X |
| 4,497,765 | 2/1985 | Wilde et al. . | |
| 4,636,328 | 1/1987 | Flynn et al. | 220/522 X |
| 4,658,976 | 4/1987 | Pohlenz . | |
| 4,664,279 | 5/1987 | Obrist et al. | 215/525 X |
| 4,667,818 | 5/1987 | Evans | 215/DIG. 8 X |
| 4,720,351 | 1/1988 | Flynn et al. | 220/522 X |
| 4,896,782 | 1/1990 | Hawkins | 215/341 X |
| 5,050,753 | 9/1991 | Trump et al. | 215/252 |
| 5,056,659 | 10/1991 | Howes et al. . | |
| 5,056,681 | 10/1991 | Howes | 220/522 |
| 5,096,078 | 3/1992 | McQueeny | 220/256 X |
| 5,103,990 | 4/1992 | Irwin . | |
| 5,114,011 | 5/1992 | Robins, III | 251/DIG. 8 X |
| 5,161,711 | 11/1992 | Picozza et al. | 220/256 X |
| 5,205,426 | 4/1993 | McBride et al. . | |
| 5,225,165 | 7/1993 | Perlman | 215/295 X |
| 5,356,021 | 10/1994 | McBride et al. . | |
| 5,392,939 | 2/1995 | Hidding et al. | 215/227 X |
| 5,439,103 | 8/1995 | Howes | 215/227 X |

FOREIGN PATENT DOCUMENTS

| | | | |
|---|---|---|---|
| 245474 | 2/1966 | Austria | 220/521 |
| 2172793 | 10/1986 | United Kingdom | 215/DIG. 7 |

*Primary Examiner*—Allan N. Shoap
*Assistant Examiner*—Robin A. Hylton
*Attorney, Agent, or Firm*—Dressler, Goldsmith Milnamow & Katz, Ltd.

[57] ABSTRACT

A removable inner compartment promotional closure includes a plastic closure cap having a circular top wall portion and a depending annular skirt portion depending from the top wall portion. A circular, resilient liner is positioned in the cap, and has a retaining element extending therefrom. A removable compartment member is positioned in the closure cap in engagement with the retaining element. The compartment defines an interior compartment adapted to receive promotional indicia, such as a promotional game piece, therein. The compartment is adapted to release from the cap after the cap is removed from the container. A sealed cover element may be positioned to extend over and close the compartment member, to isolate the compartment from the contents of the container. The promotional closure is used in conjunction with a simulated promotional closure, which configured to be is indistinguishable from the promotional closure cap. A promotional gaming system includes a plurality of the simulated promotion containing closures and the promotional closures provided on respective containers. Purchasers of the soft drink with the promotional closure will be instantly rewarded upon opening the container and compartment by receiving the promotional piece, "on-the-spot." Purchasers of the soft drink with the simulated promotional closure may be consoled by indicia, such as "please try again" appearing in the simulated promotional closure.

19 Claims, 4 Drawing Sheets

REMOVABLE INNER PROMOTIONAL COMPARTMENT CLOSURE AND PROMOTIONAL GAMING SYSTEM

FIELD OF THE INVENTION

This invention relates to promotional closures for containers and more particularly to promotional closures having a removable inner compartment for storing promotional indicia, and a promotional gaming system therefor.

BACKGROUND OF THE INVENTION

Various types of container closures, such as those used for sealing bottled soft drinks, are known in the art. One such commonly used closure is formed of plastic and includes a circular top wall portion and an internally threaded depending skirt portion which threads onto an associated container. For improved sealing, many such closures include a liner positioned on the inside surface of the top wall.

Examples of such closures and methods of making such closures are disclosed in U.S. Pat. Nos. 5,205,426 to McBride et al. and 4,497,765 to Wilde et al., hereby incorporated by reference.

Soft drink manufacturers and bottlers presently use closures and closure liners for promotional campaigns. Container closures and liners have been used as redemption pieces for reduced pricing or rebates, and sweepstakes or game prize pieces, in many known promotional campaigns.

In a typical promotional application, a logo or other representation for prize redemption, such as a prize award amount or item, is printed or transferred onto the inside of the closure cap or liner.

Such prize pieces, however, must be redeemed through either the retailer or directly through the soft drink manufacturer or bottler. While this type of promotional campaign, for the most part, is effective and is well accepted by the consuming public, it does not provide the consumer with the excitement of being an on-the-spot, instant winner.

In many promotional campaigns, it is desirable to provide the player, i.e., the soft drink purchaser, instant gratification. As such, the promotional or gaming piece itself, must have a value, preferably in cash, or otherwise instantly redeemable. In such a promotional campaign, it is most preferable to provide a closure cap which can contain or store the promotional piece within cap.

The promotional piece, however, should be protected from pilferage, and should also be isolated from the contents of the container. Where, for example, as part of the promotion, cash incentives are packaged in the closure, the incentives must be packaged within the closure to prevent pilferage when the containers are stored on a food market shelf. The cash or other incentives must also be isolated from the contents of the container, i.e., the soft drink, for sanitary reasons.

Moreover, such a closure should also be configured such that the promotional piece can be removed from the closure, without adversely affecting the ability of the closure to retain a seal with the container.

In such a promotional campaign, it may also be desirable to provide a promotional piece without such a cash incentive, urging the purchaser to "please try again."

Thus, there continues to be a need for a promotional closure and gaming system which provides instant gratification to the purchaser, while allowing ready access to and removal of the promotional indicia before the associated container is emptied. It is also desirable for such a promotional closure to be configured such that removal of the game piece does not adversely affect the sealing capabilities of the closure.

SUMMARY OF THE INVENTION

A removable inner compartment promotional closure includes a plastic closure cap having a circular top wall portion and a depending annular skirt portion depending from the top wall portion. A circular, resilient liner is positioned in the cap, and has a first side adjacent to the top wall portion and second side having a retaining element extending therefrom.

A removable compartment member is positioned in the closure cap, extending from and adjacent to the second side of the liner. The compartment member defines an interior compartment adapted to receive promotional indicia therein. The compartment member includes a flange extending therefrom which is configured to coact with the retaining element of the liner to retain the compartment member in place in the cap when the cap is engaged with an associated container. The compartment member is adapted to release from the cap after the cap is removed from the container.

In a preferred embodiment, a sealed cover element extends over and closes the compartment member to isolate the contents of the compartment from the contents of the container. The cover element may include an unsealed peripheral region to facilitate removal and to provide access to the compartment. Alternatively, the compartment can be configured to split or open by the provision of one or more preferentially weakened regions.

In one embodiment, the flange includes a circumferentially extending bifurcated region which defines annular inner and outer walls. The retaining element includes a circumferentially extending retention bead extending from the liner which is configured to be received between the annular inner and outer walls. With the closure in place on the container, the container urges the outer wall inwardly to engage the retention bead to retain the compartment member in place in the cap.

In another embodiment, the retaining element comprises at least one deformable projection depending from the liner. The deformable projection is configured to be urged over the edge of the flange to retain the compartment member in place in the cap when said cap is engaged with the container.

In yet another embodiment of the invention, the liner includes an annular bead portion at a juncture of the depending skirt and the top wall portion. The retaining element is defined by a deformable portion of the annular bead positioned over a periphery of the flange when the cap is engaged with the container.

The removable compartments may each include grasping members, such as wall extensions, pull rings, flanges, and the like to facilitate removing the respective compartments from the closures.

The promotional closure may be used in conjunction with a simulated promotional closure which includes a closure cap essentially identical to and indistinguishable from the promotional closure cap. The simulated closure includes a molded-in liner positioned in the cap, having a first side adjacent to the top wall portion. The liner includes an annular sealing bead portion for providing a seal between the closure and the container when the closure is engaged therewith. The liner further includes a non-sealing, depending, simulated promotional pocket, having a sleeve-like shape. The pocket is open to the container and is configured so as to simulate a promotional compartment. The pocket may be provided with indicia such as "please try again."

A plurality of the simulated promotion containing closures and the promotional closures will be provided on respective containers. The closures are substantially indistinguishable one from the other when they are engaged with their respective containers, and when the containers are filled with a soft drink. Thus, purchasers of the soft drink with the promotional closure will be instantly rewarded upon opening the container and compartment by receiving the promotional piece (which may be a cash incentive), "on-the-spot." Those who purchase the soft drink with the simulated promotional closure will no doubt be disappointed, however, they may be consoled by indicia, such as "please try again" appearing in the closure.

Other features and advantages of the present invention will be apparent from the following detailed description, the accompanying drawings, and the appended claims.

DETAILED DESCRIPTION OF THE PREFERRED EMBODIMENTS

Figure 1:
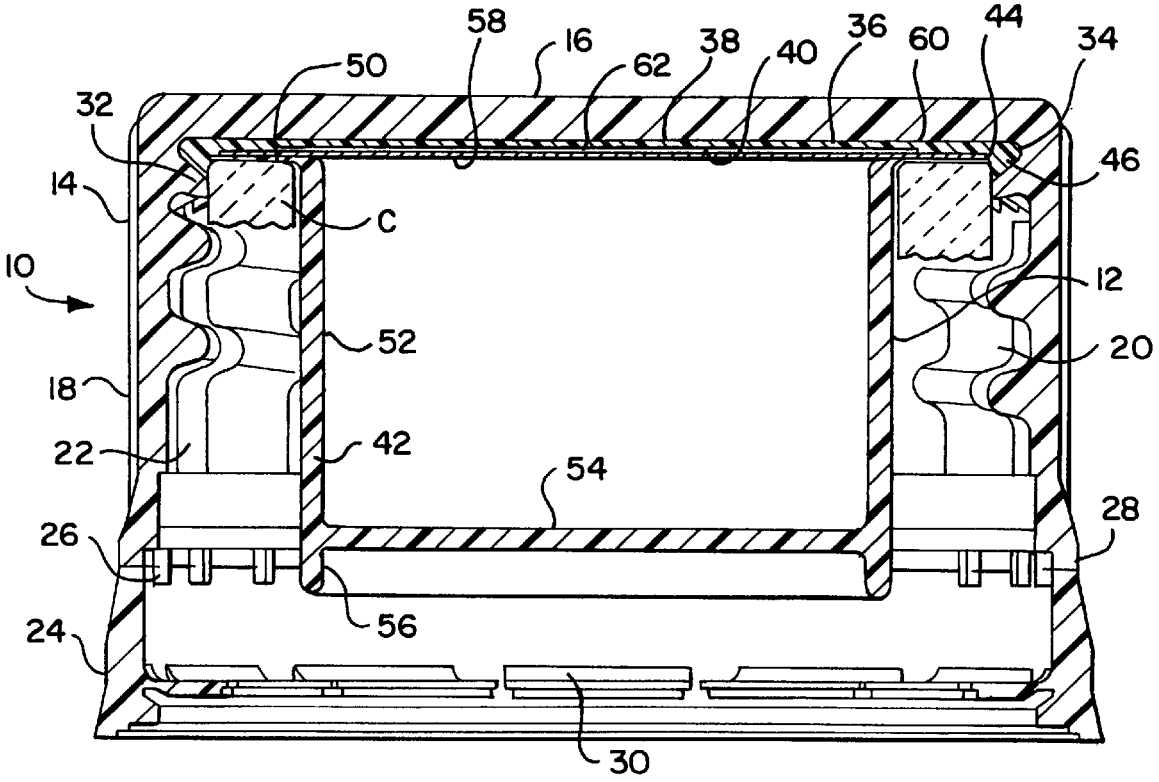
FIG. 1 is a cross-sectional view of an exemplary closure having a removable inner promotional compartment closure embodying the principles of the present invention, the closure being illustrated with a portion of a container engaged therewith.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

With reference now to FIG. 1, there is shown an exemplary closure 10 having an embodiment of the removable, inner promotional compartment 12 positioned therein. As illustrated, closure 10 is generally cup shaped and includes a closure cap 14, a circular top wall portion 16 and a depending annular skirt portion 18 depending from the top wall portion 16.

Skirt portion 18 has an internal thread formation 20 on the inside surface thereof for threadedly engaging a cooperative container C to which the closure 10 is fitted. Vent grooves 22 which extend axially along the inside of skirt portion 18 traverse the thread formation 20. The vent grooves 22 facilitate the release and venting of gas which may pressurize the container when the container is used to store, for example, carbonated beverages.

In a preferred embodiment, closure 10 is formed with a pilfer band 24 to provide visible discernible evidence that the closure 10 has been partially or completely removed from the container C. The pilfer band 24 is connected to the skirt portion 18 by a plurality of frangible rib-like bridges 26 which extend between the inside surfaces of the skirt portion 18 and the pilfer band 24. The pilfer band 24 is otherwise separated and distinguished from the skirt portion 18 by a circumferential score line 28 which extends through the side wall of the closure 10 and partially into the frangible ribs 26.

The pilfer band can be configured in accordance with the teachings of U.S. Pat. No. 4,938,370 to McBride, and formed attendant to compression molding of the closure in accordance with the teachings of U.S. Pat. No. 4,497,765 to Wilde et al.; both of which patents are commonly assigned herewith, and both of which patents are hereby incorporated by reference.

In the exemplary closure 10, the pilfer band 24 has a plurality of inwardly extending tabs 30. Upon initial engagement of the closure 10 to the container C, the tabs 30 pivot in an upward manner and pass over an annular locking ring (not shown) of the container. Pilfer indication is provided in that upon the first removal of the closure 10 from the container C, the tabs 30 engage the locking ring and provide sufficient resistance so that the pilfer band 24 separates from the skirt portion 18 at the score line 28.

In a current embodiment, as best seen in FIG. 1, the closure 10 has a lip 32 extending upwardly and inwardly of the closure 10 generally at the juncture of the top wall portion 16 and the skirt portion 18. Lip 32 extends circumferentially of the closure 10, and may be formed as a continuous element, or may be formed in discrete segments. A recess 34 may be formed between the lip 32 and the top wall portion 16.

A liner 36 may be formed in closure 10 using a molded-in process such as that disclosed in the aforementioned U.S. Pat. No. 4,497,765 to Wilde et al. Alternately, the liner 36 may be of the insert-type, which is positioned in the closure 10 after formation of the liner 36. The liner 36 has a first side 38 which is positioned adjacent the top wall portion 16, and a second side 40 which extends inward of the closure 10. The liner 36 is preferably formed from substantially opaque material to deter detection of the promotional compartment 12 and/or its contents.

The liner 36 can be formed from an ethyl vinyl acetate (EVA) polyethylene material. However, other moldable, resilient, food-grade, plastic materials can be employed. Such materials and their properties are as disclosed in U.S. Pat. No. 4,658,976 to Pohlenz.

In the embodiment of the closure 10 illustrated in FIG. 1, the removable, inner promotional compartment 12, includes a generally cup-shaped body 42, having a flange portion 50. The flange 50 is configured to engage a retaining element 44 which is defined by a portion of the liner 36. In the illustrated embodiment, the retaining element 44 is defined by a bead-like portion 46 of the liner 36, which extends, in part, into the recess 34 of the cap 14.

When the closure 10 is assembled, the flange portion 50 is adjacent to and in contact with the second side 40 of the liner 36. A cylindrical, depending wall 52 depends from the flange portion 50 and defines the compartment 12. A circular end cap 54 extends across the depending wall 52 to enclose the compartment 12. The compartment 12 may also include a wall extension 56 which provides a grasping region to facilitate removing the compartment 12 from the closure 10.

The compartment 12 preferably includes a sealed cover element 58 which extends across at least a portion of the flange 50, and seals the open end of the compartment 12 from the closure 10 and from the contents of the container C. The cover element 58 may be formed of a non-porous material, such as aluminum, an aluminum-polymer laminate structure or the like. The cover member may be sealed to the flange 50 by methods such as heat sealing, hot melt gluing and the like, such methods being recognized by those skilled in the art.

The sealed area between the cover element 58 and the flange 50 may extend across the flange 50 width, or across only a part thereof, circumferentially sealing the compartment 12, and defining an unsealed peripheral region or removal region 60, for grasping and removing the cover element 58 from the compartment 12. In a preferred embodiment, the cover element 58 has a smaller diameter than the flange 50, so that the element 58 does not extend to the end of the flange, to prevent contact between the cover element 58 and the contents of the container. Thus, the cover member 58 is encapsulate in the food grade liner 36 and compartment 12 materials.

When the closure 10 is engaged with the container C, the flange 50 is disposed between the top surface T of the container finish F and the liner 36. The flange 50 is of sufficient diameter to extend across the container C opening and abut the retaining element 44. As the closure 10 is snugly engaged with the container C, the retaining element 44 is deformed to engage the flange 50 i.e., overlap the edge, and retain the compartment 12 in place in the closure 10. With the compartment 12 in place in the closure, a relatively small gap 62 is defined between the liner 36 and the sealed cover element 58.

Figure 2:
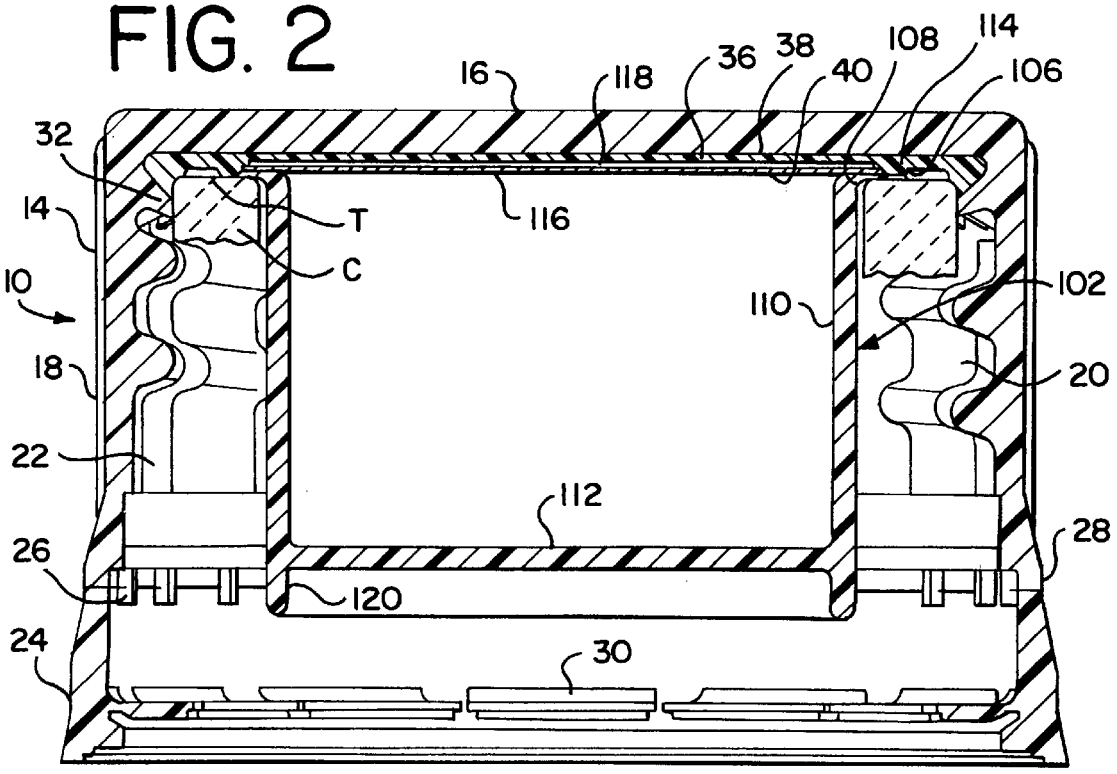
FIG. 2 is a cross-sectional view of an exemplary closure having an alternate embodiment of the removable inner promotional compartment.
Figure 3:
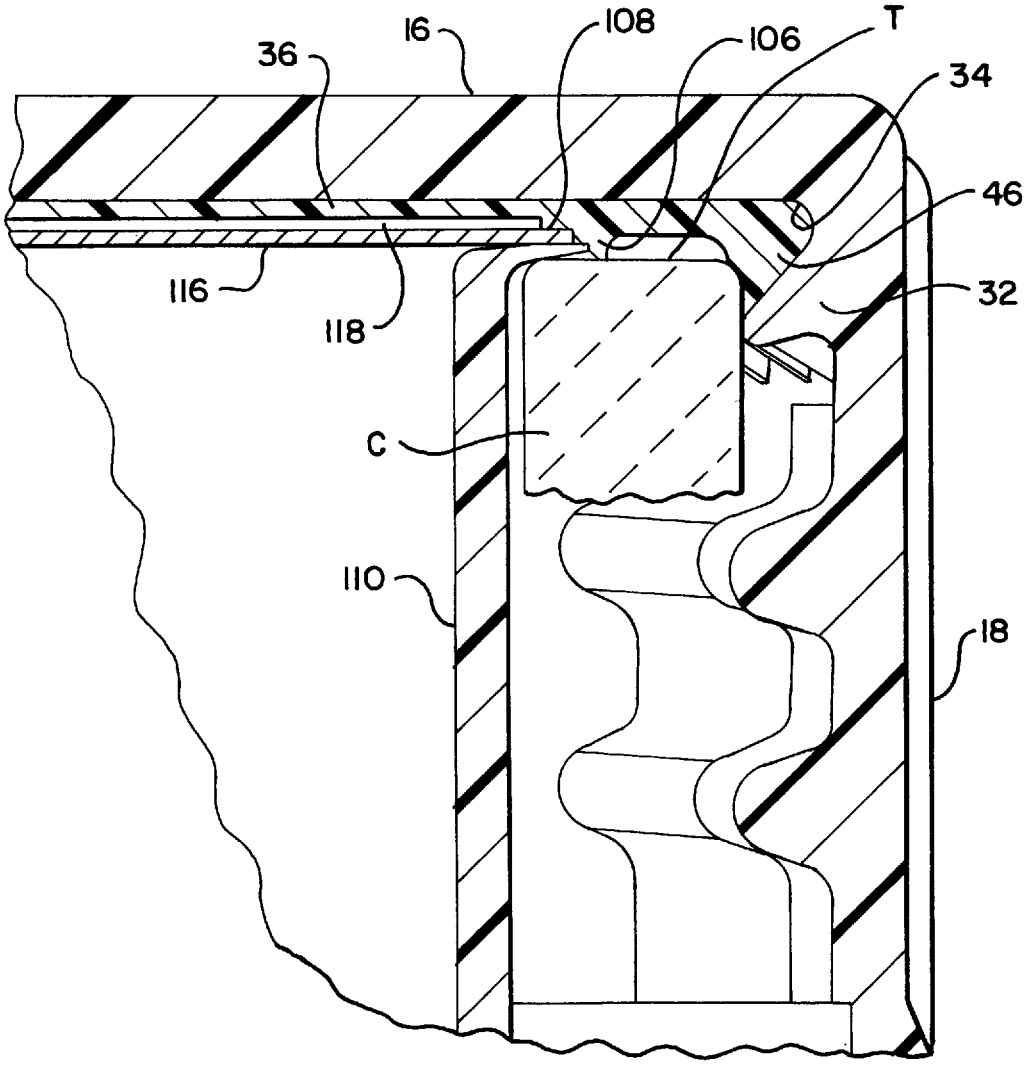
FIG. 3 is an enlarged, partial cross-sectional view of the closure of FIG. 2, illustrating the engagement of the removable inner compartment and the closure cap.

An alternate embodiment of the compartment 102 is illustrated in FIGS. 2 and 3. In this embodiment, the retaining element 104 of the closure liner 36 includes a deformable projection 106 extending from the second side 40 of the liner 36. The deformable projection is disposed inwardly of the liner bead portion 46.

Like the embodiment of the compartment 12 of FIG. 1, the embodiment 102 of FIGS. 2 and 3 includes a flange portion 108, a depending cylindrical wall 110 and an end cap 112. The flange portion extends across a part of the container finish top surface T. The deformable projection 106 is configured to coact with the top surface T when the closure 10 is engaged with the container C and to deform inwardly to engage at least a portion of the edge or periphery 114 of the flange. Thus, as the closure 10 is snugly threaded onto the container C, the deformable projection 106 is urged over the flange edge 114 and retains the compartment 102 in place in the closure 10.

The projection 106 may be circumferentially continuous. Alternately, the projection 106 may be formed as discrete, circumferentially spaced elements.

The compartment 102 may include a sealed cover element 116 to isolate the contents of the compartment 102 from the contents of the container C. With the compartment 102 in place in the closure 10, a small gap 118 is defined between the cover element 116 and the liner 36. The compartment optionally includes an extended wall portion 120 to provide a grasping region to facilitate grasping and removing the compartment 102 from the closure 102.

Figure 3A:
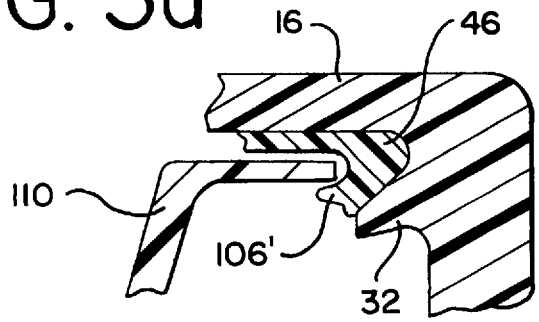
FIG. 3*a* is a fragmentary, cross-sectional view illustrating an alternative embodiment of the closure illustrated in FIG. 3.

In the modified embodiment illustrated in FIG. 3*a,* the deformable projection of the liner, designated 106', is positioned generally adjacent to and just inwardly of tip 32 of the closure. By this disposition, the projection 106' is engageable with a generally outwardly facing surface of the associated container attendant to creation of a so-called top/side seal at bead 46. As in the previous embodiment, projection 106' desirably cooperates with the container to retain the wall 110 of the associated compartment.

Figure 4:
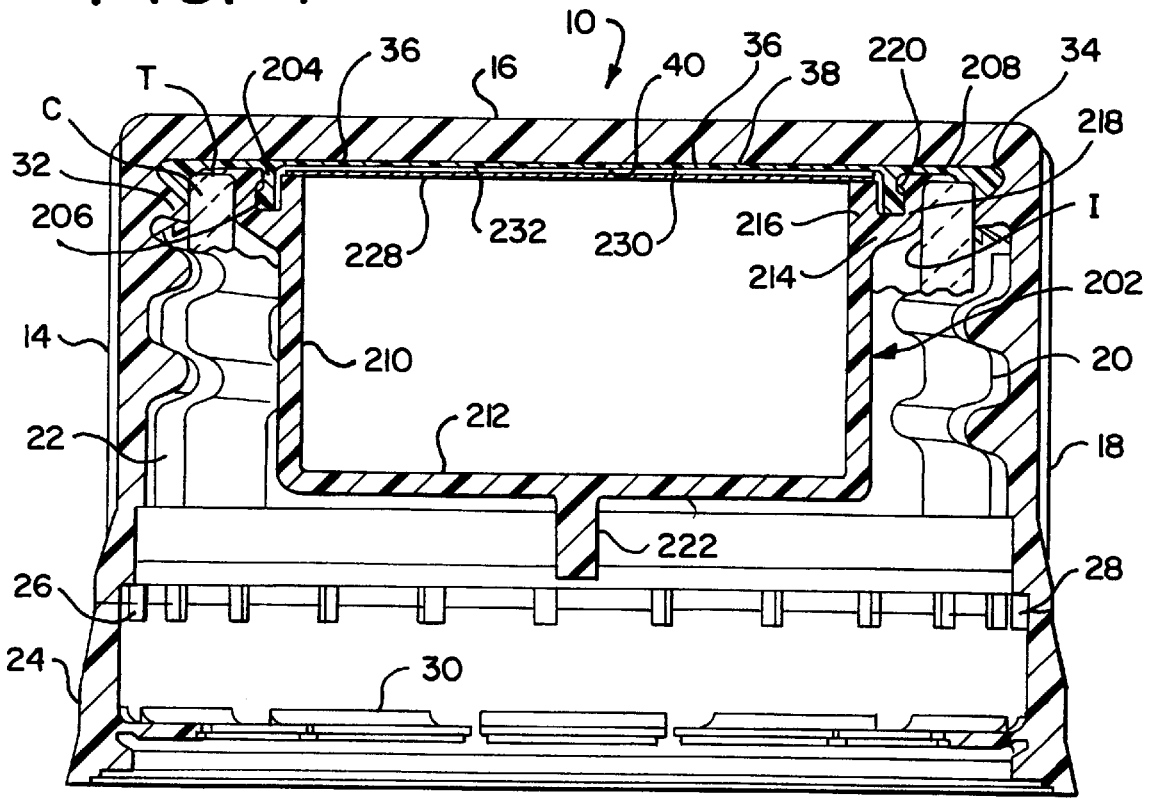
FIG. 4 is a cross-sectional view of an exemplary closure having another alternate embodiment of the removable inner promotional compartment.
Figure 6:
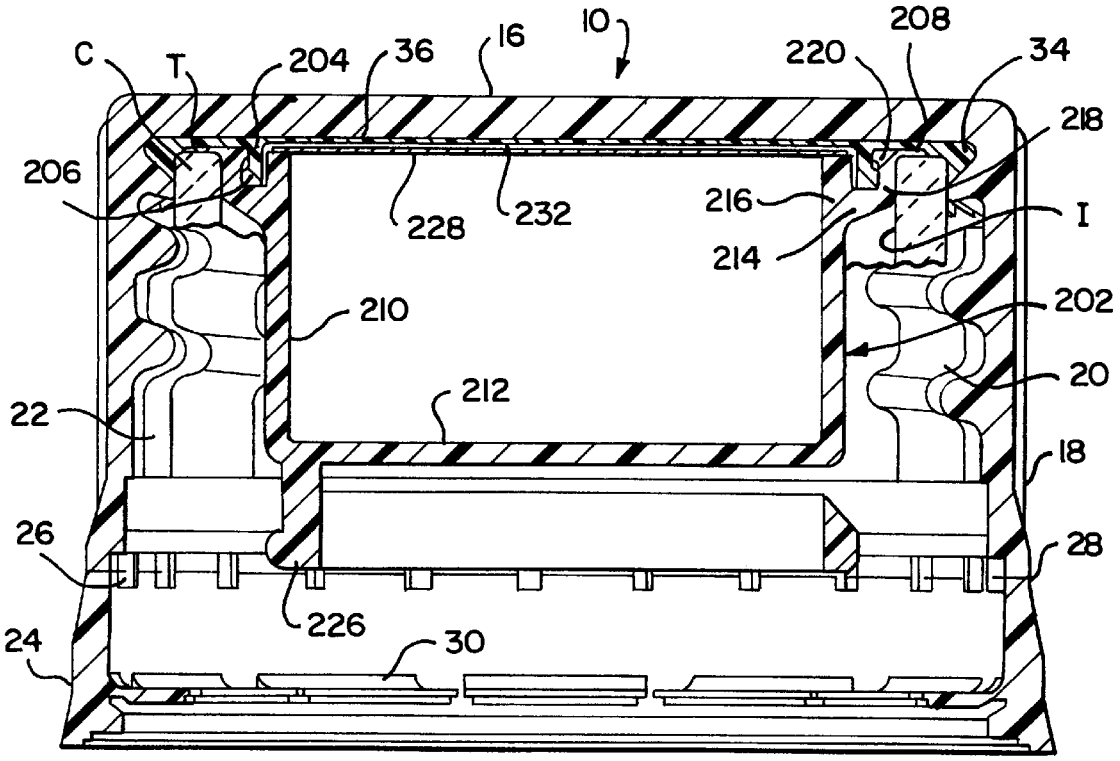
FIG. 6 is a cross-sectional view of an exemplary closure having a removable inner promotional compartment similar to that illustrated in FIG. 4, having an alternate configuration for a grasping member for facilitating removal of the promotional compartment from the closure.
Figure 7:
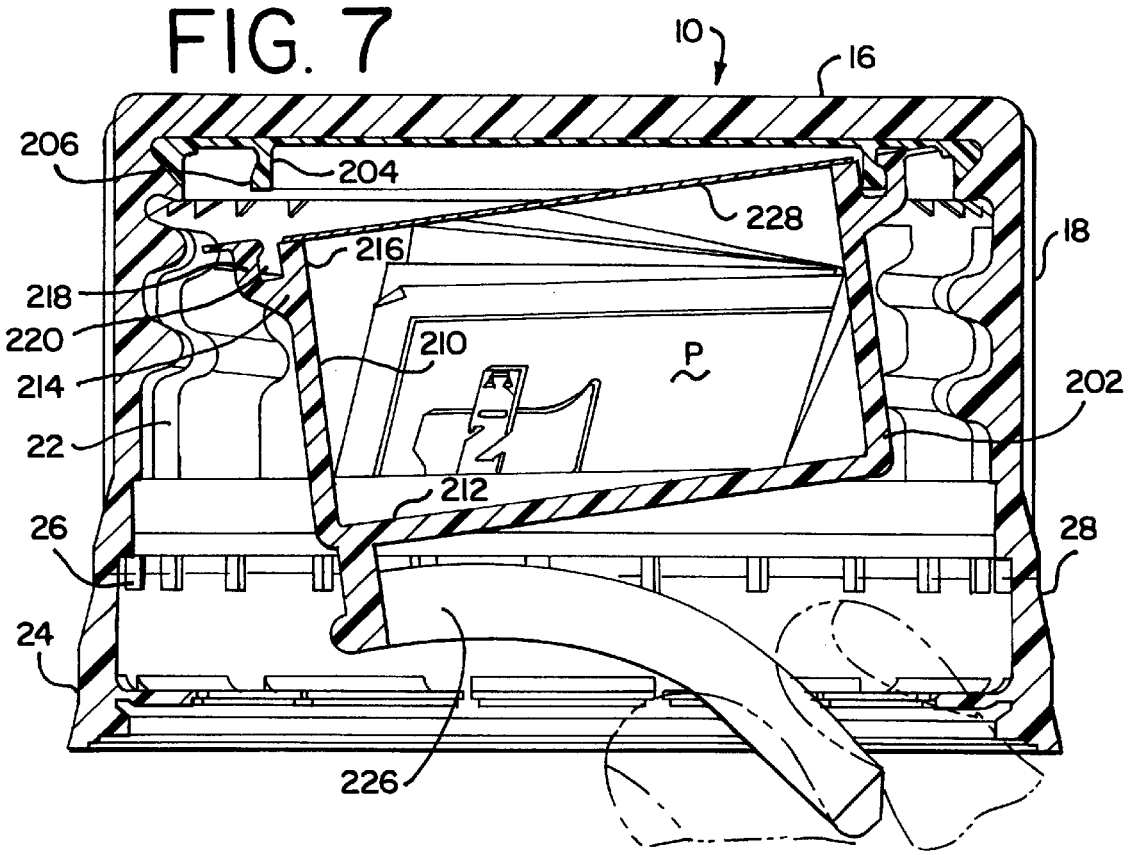
FIG. 7 is a cross-sectional view of the exemplary closure and removable inner promotional compartment of FIG. 6, with the promotional compartment having a one-dollar bill therein, and with the promotional compartment being partially removed from the closure.

Another embodiment of the compartment 202 is illustrated in FIGS. 4, 6 and 7. In order to retain the compartment 202 in place in the closure 10, the liner 36 has a retaining element 204 formed thereon. In a preferred embodiment, the retaining element 204 includes a hook-like portion 206 at an end thereof. The compartment 202 includes a flange portion 208 which, when the closure 10 is assembled, is disposed adjacent to, and in contact with, the second side 40 of the liner 36.

A depending cylindrical wall 210 depends from the flange portion 208. An end cap 212 extends across the end of the depending wall 210 and encloses the compartment 202. The flange portion 208 includes a circumferentially extending bifurcated region 214 at an end proximal to the liner 36. The bifurcated region 214 defines annular inner and outer walls 216 and 218 which are configured to receive the retaining element 204 therein. In a preferred embodiment, the outer wall 218 is configured with a hook receiving region 220 which is adapted to coact with and engage the retaining element hook-like portion 206, to retain the compartment 202 in place in the closure 10 when the closure is engaged with the container C.

As illustrated in FIG. 4, when the closure 10 is threaded onto the container C, the finish top surface T engages at least a portion of the flange 208 to hold the compartment 202 in place. In addition, the inner surface I of the container finish F urges the outer wall 218 and hook receiving region 220 into engagement with the hook-like portion 206 formed in the liner 36.

The compartment 202 optionally includes a grasping member, such as the illustrated flange 222 to facilitate removing the compartment 202 from the closure. Alternately, as illustrated in FIG. 6, the grasping member may include a pull ring 226, formed as part of the compartment 202. It will be recognized by those skilled in the art that other configurations for grasping members may be used to facilitate removing the compartment 202 from the closure 10, which other configurations are to be considered within the scope of the present invention.

The compartment 202 may also include a sealed cover element 228 to isolate the contents of the compartment 202 from the contents of the container C. In the embodiment illustrated in FIG. 4, the cover element 228 includes a removal tab 230 which can be pulled upward, relative to the compartment, to remove the cover element 228 after the compartment 202 is removed from the closure 10. It will be readily recognized that the removal tab 230 can be provided in any of the compartment embodiments 12, 102, 202 disclosed herein. With the compartment 202 in place in the closure 10, a small gap 232 is defined between the cover element 228 and the liner 36.

Figure 5:
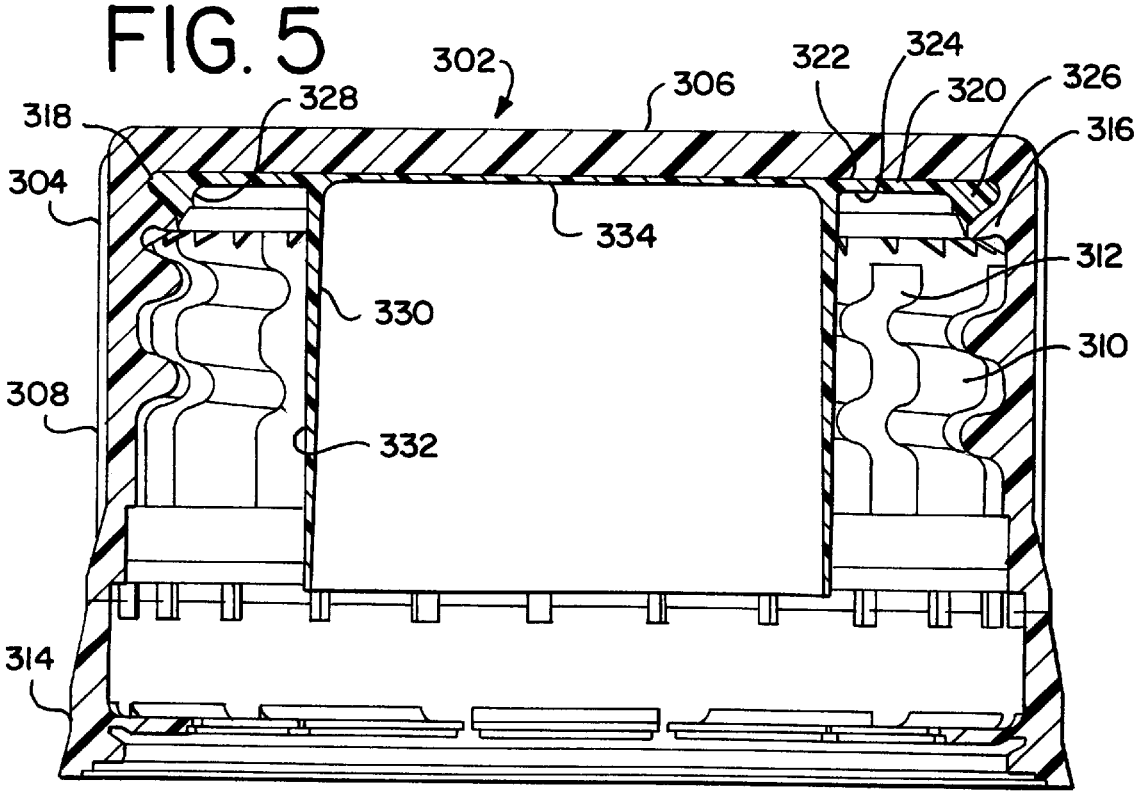
FIG. 5 is a cross-sectional view of an exemplary closure having a simulated promotion pocket in accordance with an aspect of the present invention.

It is presently contemplated that the promotional closure 10 including the removable compartment member 12, 102, 202 will be used in a promotional gaming system. The gaming system will include a plurality of closures 10 which include the removable compartment 12, 102, 202, and a plurality of simulated promotion containing closures 302, an exemplary one of which is illustrated in FIG. 5.

The simulated closure 302 includes a plastic closure cap 304 which is similar to cap 14. The cap 304 includes a circular top wall portion 306 and a depending annular skirt portion 308 depending from the top wall portion 16.

The skirt portion 308 has an internal thread formation 310 on the inside surface thereof for threadedly engaging a cooperative container C to which the closure 302 is fitted. Vent grooves 312 which extend axially along the inside of the skirt portion 308 traverse the thread formation 310. The vent grooves 312 facilitate the release and venting of gas which may pressurize the container when the container is used to store, for example, carbonated beverages.

Similar to the closure 10, closure 302 may be formed with a pilfer band 314 to provide visible discernible evidence that the closure 302 has been partially or completely removed from the container. The pilfer band can be configured in accordance with the teachings of the aforementioned U.S. Pat. No. 4,938,370 to McBride, and formed in accordance with the teachings of the aforementioned U.S. Pat. No. 4,497,765 to Wilde et al.

The closure 302 has a lip 316 extending upwardly and inwardly thereof generally at the juncture of the top wall portion 306 and the skirt portion 308. Lip 316 extends circumferentially of the closure 302, and may be formed as a continuous element, or may be formed in discrete segments. A recess 318 is formed between the lip 316 and the top wall portion 306.

A liner 320 may be formed in the closure 302 using a suitable molded-in process. The liner 320 has a first side 322 which is formed adjacent to the top wall portion 306, and a second side 324 which extends inward of the closure 302. The liner 320 is retained in place in the closure 302 by a retaining bead 326 which extends circumferentially around the liner 320, into the recess 318, and engages the lip 316, and/or by bonding the liner to the closure. The retaining bead 326 defines, in part, a sealing bead portion 328.

An open, non-sealing, depending simulated promotional pocket 330 depends from the second side 324 of the liner 320. The pocket 330 extends downward, relative to the liner 320, and is open to the contents of the container C. The pocket 330 is configured such that the outer wall 332 thereof does not form a seal with the inner surface of the container finish (not shown).

The simulated promotional closure 302 is configured to resemble and to be indistinguishable from the promotional closure 10, when the closures 10, 302 are placed on and engaged with their respective containers C. The containers and contents will, of course, be identical thus enhancing the inability to distinguish between the closures 10, 302.

The gaming system includes a plurality of promotional closures 10 having promotional pieces P, such as a one-dollar bill, therein, and a plurality of simulated promotional closures 302. All of the closures 10, 302 will be engaged with a container, in commonly recognized fashion. As previously provided, the promotional closures 10 and the simulated promotional closures 302 will be indistinguishable, one from the other, when placed on a container which is filled with a soft drink. Purchasers of the soft drink with the promotional closure will be instantly rewarded upon opening the container and compartment by receiving, "on-the-spot," the promotional piece. Those who purchase the soft drink with the simulated promotional closure 302 will no doubt be disappointed, however, they may be consoled by indicia 334, such as "please try again" appearing in the closure.

In this regard, it is within the purview of the present invention to provide at least one of the simulated promotional closures 302 with indicia means therein, which may be printed, molded, or otherwise provided. Such indicia means can be associated with an additional award of the present gaming system, thus providing a "game-within-a-game", a plural mode by which consumers can receive promotions from the gaming system. Thus, even those closures of the system not containing promotional items within a compartment may nevertheless be employed for potential awards.

It will be recognized by those skilled in the art, that one benefit of the removable inner compartment promotional closure 10, is that the promotional compartment 12, 102, 202 can be removed from the closure 10, and the closure 10 will maintain its ability to seal the container C, so that the compartment 12, 102, 202 can be immediately removed from the closure 10, without adversely affecting the closure's ability to seal the container C.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A promotional closure for use with an associated container, comprising:

a plastic closure cap having a circular top wall portion and a depending annular skirt portion depending from the top wall portion;

a circular, resilient liner positioned in said plastic closure cap and having a first side adjacent the top wall portion and a second side, said second side having a retaining element extending therefrom comprising at least one deformable projection depending from said liner; and a removable compartment member positioned in said closure cap, extending from and adjacent to said second side of said liner, said compartment member defining an interior compartment to receive promotional indicia therein, said compartment member including a flange extending therefrom configured to coact with said retaining element to retain said compartment member in place in said cap when said cap is engaged with the container by urging of said deformable projection of said retaining element to overlap said flange.

2. The promotional liner and closure of claim 1 including a sealed cover element extending over and closing said compartment member, said cover member being positioned adjacent to said liner second side when said compartment member is positioned in said cap, and being removable from said compartment member to provide access to said compartment.

3. The promotional liner and closure of claim 1 wherein said retention bead comprises a projection having a circumferentially extending hook-like portion to engage at least one of said inner and outer walls.

4. The promotional liner and closure of claim 3 wherein said circumferential hook-like portion is continuous.

5. The promotional liner and closure of claim 3 wherein said outer wall engages said hook-like portion.

6. The promotional liner and closure of claim 1 wherein said compartment member includes a grasping member extending therefrom for grasping said compartment member to release said compartment member from said cap.

7. The promotional liner and closure of claim 6 wherein said grasping member comprises a pull ring.

8. The promotional liner and closure of claim 2 wherein said cover element includes a removal member integral therewith and positioned over at least a portion thereof, said removal member being adapted for grasping and removing said cover from said compartment element.

9. The promotional liner and closure of claim 1 wherein said deformable projection is circumferentially continuous.

10. The promotional liner and closure of claim 1 wherein said liner includes an annular bead portion at a juncture of said depending skirt portion and said top wall portion, and wherein said retaining element comprises a deformable portion of said annular bead portion positioned over a periphery of said flange when said cap is engaged with the container.

11. The promotional liner and closure of claim 2 wherein said seal cover element includes an unsealed peripheral portion to provide a removal member.

12. The promotional liner and closure of claim 1 wherein said compartment member includes an extended wall portion to provide a grasping region to remove said compartment from said cap.

13. The promotional liner and closure of claim 1 wherein said compartment member includes at least one projection extending therefrom to provide a grasping region to remove said compartment from said cap.

14. A simulated promotion containing closure for use with an associated container comprising:

a plastic closure cap having a circular top wall portion and a depending annular skirt portion depending from the top wall portion, said closure cap having an annular liner-engaging element positioned at a juncture of said top wall portion and said skirt portion; and a circular, resilient, molded-in liner positioned in said plastic closure cap and having a first side adjacent the top wall portion and a second side, said liner including an annular sealing bead portion for providing a seal between said closure and the container when said closure is engaged therewith, said annular sealing bead portion being positioned in engagement with said annular liner-retaining element of said closure cap, said liner including a non-sealing, depending, simulated promotional pocket, having a sleeve-like shape and being spaced radially inwardly of said annular sealing bead portion, said simulated promotional pocket being open to the container and configured so as to simulate a promotional compartment.

15. A simulated promotion containing closure in accordance with claim 14, wherein said annular liner-engaging element defines an annular recess with said top wall portion.

16. A promotional gaming system for use with associated containers, comprising:

a plurality of promotional closures including a plastic closure cap having a circular top wall portion, and an annular skirt portion depending from the top wall portion and a circular liner positioned adjacent said top wall portion, said cap including a removable compartment member positioned therein, extending from and adjacent to said liner, said compartment member defining an interior compartment to receive a promotional gaming piece therein, said compartment member being configured to release from said cap after said cap is removed from the container; and a plurality of simulated promotion containing closures having a plastic closure cap having a circular top wall portion and a depending annular skirt portion depending from the top wall portion, and a circular, resilient, molded-in liner positioned in said plastic closure cap and having a first side adjacent the top wall portion and second side, said liner including an annular sealing bead portion for providing a seal between said closure and the container when said closure is engaged therewith, said liner including a non-sealing, depending, simulated promotional pocket, having a sleeve-like shape, said simulated promotional pocket being open to the container and configured so as to simulate a promotional compartment, wherein said simulated promotion containing closures and said promotional closures are substantially indistinguishable when said closures are engaged with their respective associated containers, when the containers are filled with a soft drink.

17. The promotional gaming system of claim 16, wherein said promotional closures each include a resilient liner positioned in said plastic closure cap adjacent said top wall portion and having a retaining element extending therefrom, said compartment member being configured to coact with said retaining element to retain said compartment member in place in said cap when said cap is engaged with the container.

18. The promotional gaming system of claim 16, wherein at least some of said simulated promotion containing closures include indicia means visible therein, said indicia means being associated with an additional award of said gaming system.

19. A promotional closure for use with an associated container, comprising:

a plastic closure cap having a circular top wall portion and a depending annular skirt portion depending from the top wall portion;

a circular, resilient liner positioned in said plastic closure cap and having a first side adjacent the top wall portion and a second side, said second side having a retaining element extending therefrom; and a removable compartment member positioned in said closure cap, extending from and adjacent to said second side of said liner, said compartment member defining an interior compartment to receive promotional indicia therein, said compartment member including a flange extending therefrom configured to coact with said retaining element to retain said compartment member in place in said cap when said cap is engaged with the container, wherein said flange includes a circumferentially extending bifurcated region defining radially spaced, annular inner and outer walls, and wherein said retaining element includes a circumferentially extending retention bead extending from said liner second side, said annular inner and outer walls being configured to receive said retention bead, and wherein engagement of said cap with the container urges said outer wall inwardly to engage said retention bead to retain said compartment member in place in said cap when said cap is engaged with the container.

* * * * *

UNITED STATES PATENT AND TRADEMARK OFFICE

CERTIFICATE OF CORRECTION

PATENT NO. : 5,806,707

DATED : September 15, 1998

INVENTOR(S) : Ted W. Boehm et al.

It is certified that error appears in the above-identified patent and that said Letters Patent is hereby corrected as shown below:

Col. 8, line 58 Delete "1", and insert –19--

Signed and Sealed this

Nineteenth Day of January, 1999

*Attest:*

*Attesting Officer*

*Acting Commissioner of Patents and Trademarks*